US005877673A

United States Patent [19]

Kotani et al.

[11] Patent Number: 5,877,673

[45] Date of Patent: Mar. 2, 1999

[54] ELECTRIC COMPONENT WITH SOLDERING -LESS TERMINAL STRUCTURE

[75] Inventors: Hirokazu Kotani, Yatsuo-machi; Yasuaki Horioka, Kosugi-machi, both of Japan

[73] Assignee: Hokuriku Electric Industry Co., Ltd., Kami-niikawagun, Japan

[21] Appl. No.: 995,826

[22] Filed: Dec. 22, 1997

[30] Foreign Application Priority Data

Dec. 27, 1996 [JP] Japan ..... 8-350137
Dec. 27, 1996 [JP] Japan ..... 8-350138

[51] Int. Cl.[6] ..... H01C 10/32

[52] U.S. Cl. ..... 338/162; 338/160; 338/167

[58] Field of Search ..... 338/160, 162, 338/164, 167, 168

[56] References Cited

U.S. PATENT DOCUMENTS 4,402,037 8/1983 Iwamura et al. ..... 361/428
4,471,339 9/1984 Fukada et al. ..... 338/162
5,278,535 1/1994 Xu et al. ..... 338/20
5,508,678 4/1996 Tsunezawa et al. ..... 338/160
5,532,669 7/1996 Tsunezawa et al. ..... 338/184
5,546,280 8/1996 Hasebe et al. ..... 361/752
5,579,213 11/1996 Hasebe et al. ..... 361/823

*Primary Examiner*—Lincoln Donovan
*Assistant Examiner*—Kyung S. Lee
*Attorney, Agent, or Firm*—Pearne, Gordon McCoy & Granger LLP

[57] ABSTRACT

An electric component capable of connecting terminal fitments and electrodes arranged on a front surface of a circuit board to each other in a soldering-less manner without increased accuracy in assembling thereof and without using any conductive rubber member. A terminal assembly is constituted by a terminal fitment and a coiled spring. The terminal fitment includes first and second conductor holding sections each arranged for interposedly holding an end of each of connection conductors. The coiled spring is formed of a conductive wire and arranged so as to spirally surround the connection conductor and be compressed between a contact electrode and the first conductor holding section.

12 Claims, 5 Drawing Sheets

ELECTRIC COMPONENT WITH SOLDERING -LESS TERMINAL STRUCTURE

BACKGROUND OF THE INVENTION

This invention relates to an electric component with a soldering-less terminal structure, and more particularly to an electric component with a terminal connection structure which permits connection without soldering.

Use of freon (flon) is subject to restriction in view of environmental pollution, so that it is highly required to connect a terminal conductor, a lead wire or the like to a connection electrode of a circuit board without soldering. This is likewise true of an electric component called a focus pack used for adjustment of a focus voltage of a cathode ray tube (CRT), a screen voltage thereof or the like.

U.S. Pat. No. 4,471,339 discloses a high-voltage variable resistor unit including a terminal connection structure for connecting, by means of a terminal fitment like a coiled spring provided at one end thereof with a ring into which a connection conductor or connection terminal is inserted, a connection electrode of the resistor unit to the connection terminal without soldering. Such a conventional terminal fitment as taught in the U.S. patent fails to firmly hold the connection terminal therein, to thereby cause the connection terminal to be readily released from the terminal fitment. Also, it tends to cause a failure in electric connection between the connection terminal and the terminal fitment. Further, the above-described construction of the terminal fitment requires to keep the connection terminal and connection electrode connected together prior to incorporation of a circuit board in an insulating casing. This, when use of a lead wire of an increased length is required for the connection conductor, causes the long lead wire to obstruct assembling of the high-voltage variable resistor unit. In particular, when the high-voltage variable resistor unit including the terminal connection structure is combined with a fly-back transformer, the high-voltage variable resistor must be placed in a heating oven together with the long lead wire for the purpose of subjecting a resin material for molding of the fly-back transformer to heat curing. Unfortunately, the long lead wire renders the operation highly troublesome, leading to a deterioration in production efficiency.

Also, U.S. Pat. No. 5,546,280, which corresponds to Japanese Patent Application Laid-Open Publication No. 318669/1994, owned by the assignee discloses two kinds of terminal connection structures for connecting a core wire of a lead to a connection electrode of a circuit board without soldering. FIG. 9 of the U.S. patent shows a connection structure using a plurality of terminal assemblies in each of which a terminal fitment provided with a conductor holding section for interposedly holding the core wire of the lead and a conductive rubber member are combined together. The conductive rubber member is used as a connection means for connecting a terminal fitment and a connection electrode arranged on a circuit board 1 to each other without soldering. Unfortunately, a conductive rubber material for the conductive rubber member incorporated in such construction of the U.S. patent is inherently expensive, to thereby cause an electric component or a high-voltage electric component such as a high-voltage variable resistor unit having the conductive rubber member incorporated therein to be disadvantageously increased in cost. Also, the conductive rubber member is formed by cutting an elongated linear conductive rubber material, to thereby be varied in length. Also, the conductive rubber material exhibits excessively increased elasticity. Thus, arrangement of the plural terminal assemblies often causes mounting of the electric component to be carried out while keeping the circuit board inclined due to both a variation in length of the conductive rubber members and increased elasticity thereof, to thereby render assembling of the electric component highly troublesome.

U.S. Pat. No. 5,546,280 also discloses a connection structure including a terminal fitment in which a conductor interposing or holding section and a contact terminal section exhibiting elasticity are integrally incorporated. The terminal fitment is so constructed that the elastic contact terminal section functions to connect the conductor holding section and an electrode on a circuit board to each other without soldering. Also, the U.S. patent discloses a structure for connecting a plurality of electrodes arranged on the circuit board and a plurality of connection conductors to each other without soldering, respectively. Further, the U.S. patent discloses a high-voltage variable resistor unit having the terminal fitment of such an integral type incorporated therein and constructed in such a manner that a lid member covers a board receiving chamber of an insulating casing.

In addition, U.S. Pat. No. 5,546,280 described above and U.S. Pat. No. 5,508,678 likewise owned by the assignee each disclose a terminal fitment which includes a conductor holding section for interposedly holding a connection conductor, wherein the conductor holding section is provided with a plurality of edges adapted to bite into an end of the connection conductor when drawing force is applied to the connection conductor.

The above-described terminal fitment having the conductor holding section and contact terminal section integrally incorporated therein which was proposed by the assignee is significantly reduced in the number of parts, resulting in being highly advantageous when automatic assembling of the terminal fitment is accomplished with increased accuracy. However, incorporation of the terminal fitment of the integral type into the insulating casing by manual operation causes assembling of the electric component to be deteriorated in accuracy, so that the terminal fitment is incorporated in the electrical component while being inclined. This causes a pressure of contact between the contact terminal section exhibiting elasticity and the electrode on the circuit board to be reduced, resulting in a failure in contact therebetween rarely occurring.

Also, the conventional terminal fitment wherein the conductor holding section is provided with a plurality of the edges adapted to bite into the end of the connection conductor when drawing force is applied to the connection conductor does not cause any problem so long as only the drawing force is applied thereto. However, it encounters a problem that the connection conductor is cut by the edges of the conductor holding section in the worst case, when turning force which tends to cause turning of the connection conductor about a central axis thereof is repeatedly applied to the connection conductor or the connection conductor is formed into a thin configuration.

SUMMARY OF THE INVENTION

The present invention has been made in view of the foregoing disadvantages of the prior art.

Accordingly, it is an object of the present invention to provide an electric component which is capable of accomplishing electrical connection between each of electrodes arranged on a front surface of a circuit board and each of terminal fitments without soldering while eliminating a necessity of carrying out assembling thereof with increased accuracy and a necessity of using any conductive rubber member.

It is another object of the present invention to provide an electric component which is capable of connecting two connection conductors respectively inserted thereinto from an outside of an insulating casing and an outside of a circuit board to a single electrode by means of a single terminal fitment without soldering.

It is a further object of the present invention to provide an electric component which is capable of preventing a connection conductor inserted thereinto from an outside of an insulating casing from being cut by a conductor holding section due to application of turning force to the connection conductor.

It is still another object of the present invention to provide an electric component which is capable of positively contacting a terminal fitment with an electrode arranged on a front surface of a circuit board.

It is yet another object of the present invention to provide a high-voltage variable resistor unit which is capable of accomplishing electrical connection between each of electrodes arranged on a front surface of a circuit board and each of terminal fitments without soldering while eliminating a necessity of increasing accuracy in assembling thereof and a necessity of using any conductive rubber member.

It is even another object of the present invention to provide a high-voltage variable resistor unit which is capable of connecting two connection conductors respectively inserted thereinto from an outside of an insulating casing and an outside of a circuit board to a single electrode by means of a single terminal fitment without soldering.

It is a still further object of the present invention to provide a high-voltage variable resistor unit which is capable of preventing a connection conductor inserted thereinto from an outside of an insulating casing from being cut by a conductor holding section due to application of turning force to the connection conductor.

It is an even further object of the present invention to provide a high-voltage variable resistor unit which is capable of positively contacting a terminal fitment with an electrode arranged on a front surface of a circuit board.

It is a yet further object of the present invention to provide a high-voltage variable resistor unit which is capable of being readily assembled without requiring increased accuracy.

It is another object of the present invention to provide a high-voltage variable resistor unit which is capable of fully eliminating a necessity of soldering, as well as a necessity of increasing accuracy in assembling thereof.

In accordance with the present invention, an electric component is provided which includes a circuit board formed on a front surface thereof with a circuit pattern including at least one contact electrode, an insulating casing formed so as to be open at one of ends thereof to provide an opening and provided therein with a board receiving chamber communicating with the opening, and at least one terminal assembly arranged between the circuit board and an inner surface of the insulating casing defining the board receiving chamber; wherein the circuit board is received in the board receiving chamber of the insulating casing while keeping the front surface thereof facing an inside of the board receiving chamber, the inner surface of the insulating casing is formed with at least one terminal fitment fit section, and at least one connection conductor is inserted into said board receiving chamber. In the electric component thus generally constructed, the terminal assembly includes at least one terminal fitment and at least one conductive contact member interposedly held between the terminal fitment and the contact electrode on the front surface of the circuit board. The terminal fitment includes at least one conductor holding section for interposedly holding an end of the connection conductor fitted in the terminal fitment fit section and inserted into the board receiving chamber. The conductive contact member is constituted by a coiled spring obtained by forming a conductive wire into a spiral shape. The coiled spring is arranged so as to be compressed between the contact electrode and the terminal fitment.

The coiled spring permits elasticity thereof to be finely and freely set at a desired level, resulting in readily exhibiting elasticity of a desired level lower than that of a conductive rubber material. Also, inclination of the coiled spring or terminal fitment to a degree which occurs during incorporation thereof is effectively absorbed in the form of deformation of the coiled spring. Thus, the present invention positively ensures electrical contact between the terminal fitment and the electrode on the circuit board, even when the assembling is carried out with a reduced accuracy.

Also, in accordance with the present invention, an electric component is provided, which includes a circuit board having a front surface and a rear surface, formed with a through-hole via which a first connection conductor is inserted from a side of the rear surface thereof and formed on the front surface thereof with a circuit pattern including at least one contact electrode arranged adjacent to the through-hole, an insulating casing formed so as to be open at one of ends thereof to provide an opening and provided therein with a board receiving chamber communicating with the opening and formed on an inner surface of the insulating casing defining the board receiving chamber with a connection conductor introduction section through which a second connection conductor is inserted at an end thereof into the board receiving chamber from an outside of the insulating casing, and at least one terminal assembly arranged between the circuit board and the inner surface of the insulating casing defining the board receiving chamber; wherein the circuit board is received in the board receiving chamber of the insulating casing while keeping the front surface thereof facing an inside of the board receiving chamber and the inner surface of the insulating casing is formed with at least one terminal fitment fit section. In the electric component thus generally constructed, the terminal assembly includes at least one terminal fitment and at least one conductive contact member. The terminal fitment includes a first conductor holding section for interposedly holding an end of the first connection conductor fitted in the terminal fitment fit section and inserted into the board receiving chamber via the through-hole and a second conductor holding section for interposedly holding the end of the second connection conductor inserted from the connection conductor introduction section into the board receiving chamber. The conductive contact member is interposedly supported between the first conductor holding section of the terminal fitment and the contact electrode on the front surface of the circuit board. The conductive contact member is constituted by a coiled spring obtained by forming a conductive wire into a spiral shape. The coiled spring is arranged so as to spirally surround the first connection conductor and be compressed between the contact electrode and the first conductor holding section.

Further, the present invention may be applied to electric connection between the connection conductor inserted into the board receiving chamber from the rear surface of the circuit board and the electrode on the circuit board. The terminal assembly may include the terminal fitment including the conductor holding section for interposedly holding the end of the connection conductor inserted into the board receiving chamber through the through-hole of the circuit board, as well as the conductive contact member interposedly supported between the conductor holding section of the terminal fitment and the contact electrode on the front surface of the circuit board. The conductive contact member is constituted by the coiled spring obtained by forming a conductive wire into a spiral shape. The coiled spring is arranged so as to be compressed between the contact electrode and the conductor holding section.

The present invention may be realized in the form of a high-voltage variable resistor unit. In this instance, the above-described connection structure having the terminal assembly incorporated therein may be used for any of an input electrode, a ground electrode, a focus voltage output electrode, and a screen voltage output electrode. Arrangement of the terminal assembly with respect to each of the electrodes permits connection of the connection conductor to be accomplished in a completely soldering-less manner.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

Now, the present invention will be described hereinafter with reference to the accompanying drawings.

The following description will be made in connection with a high-voltage variable resistor unit to which an electric component according to the present invention is may be applied by way of example. In general, such a high-voltage variable resistor unit is adapted to adjust a focus voltage of a CRT and a screen voltage thereof and commonly called a focus pack.

Figure 1A:
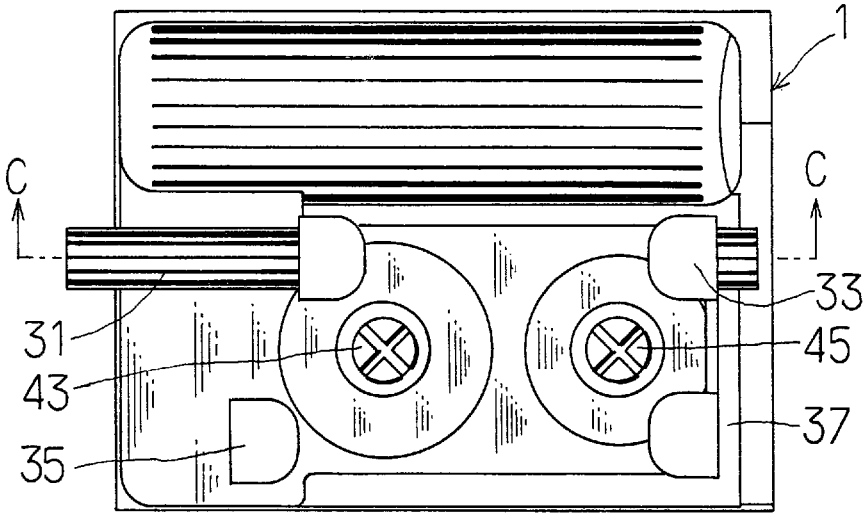
FIG. 1A is a plan view showing an embodiment of a high-voltage variable resistor unit according to the present invention.
Figure 1B:
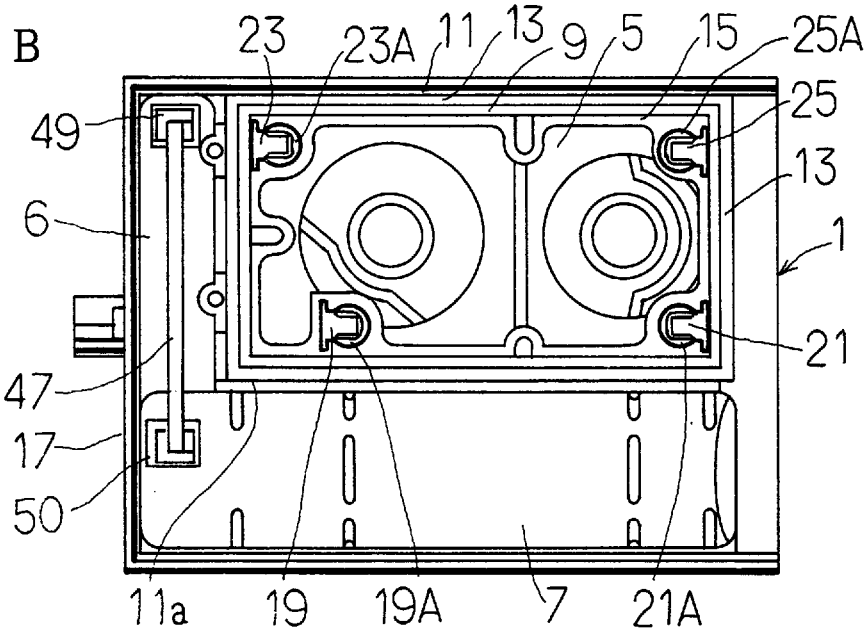
FIG. 1B is a bottom view showing an insulating casing incorporated in the high-voltage variable resistor unit shown in FIG. 1A.
Figure 1C:
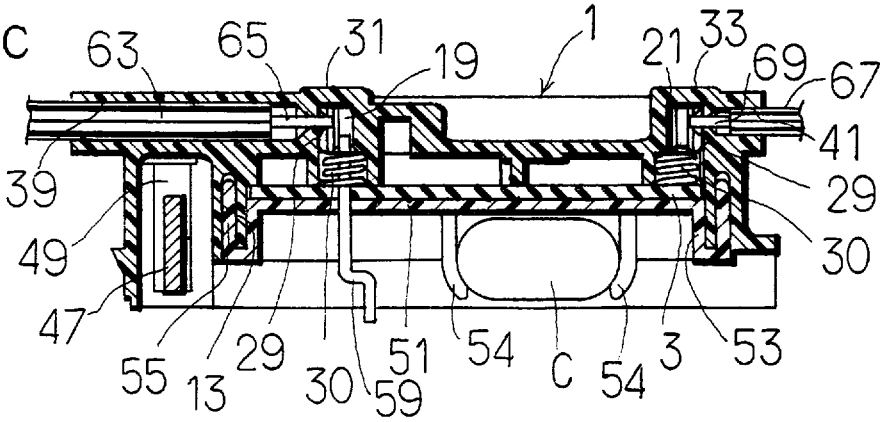
FIG. 1C is a schematic sectional view taken along line 1C—1C of FIG. 1A.
Figure 2:
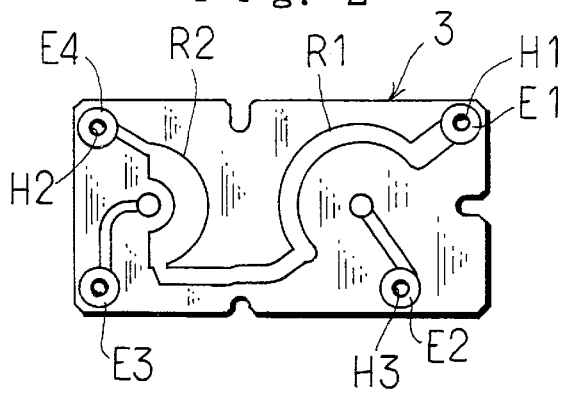
FIG. 2 is a schematic plan view showing a circuit board incorporated in the high-voltage variable resistor unit shown in FIG. 1A.

Referring first to FIGS. 1A to 2, such a high-voltage variable resistor unit is illustrated, wherein reference numeral 1 designates an insulating casing integrally made of an insulating resin material such as modified PPE resin called Noryl (trademark) resin, polybutylene terephthalate resin or the like. Reference numeral 3 designates a circuit board which is made of a ceramic material and on which an input electrode E1, a focus voltage output electrode E2, a screen voltage output electrode E3, a ground electrode E4, and a variable resistance circuit pattern including a focus voltage adjusting resistance element R1, a screen voltage adjusting resistance element R2 and the like are formed. The circuit board 3 is formed with through-holes H1 to H3 in a manner to be positioned at a central portion of the input terminal E1, ground electrode E4 and focus voltage output electrode E2 to which a capacitor is connected, into which an input connection conductor 61 (FIG. 6), a ground connection conductor and a capacitor connection conductor 59 are inserted, respectively.

The insulating casing 1 is formed so as to be open on a lower side end or bottom end thereof to provide an opening. The insulating casing 1 has a board receiving chamber 5, a fixed resistance substrate receiving chamber 6 and a capacitor receiving chamber 7 defined therein. In the illustrated embodiment, the fixed resistance substrate receiving chamber 6 and capacitor receiving chamber 7 are formed so as to communicate with each other. The insulating chamber has a double outer peripheral wall arranged around the board receiving chamber 5, which includes an inner wall section 9 and an outer wall section 11 each formed into a shape like a closed loop. The inner wall section 9 and outer wall section 11 are arranged so as to define a rectangular annular fit groove 13 therebetween. The outer wall section 11 has a wall portion 11*a* arranged along the capacitor receiving chamber 7 so as to act as a partition wall through which the board receiving chamber 5 and capacitor receiving chamber 7 are separated from each other. The inner wall section 9 is provided on an inside thereof with a board supporting rib 15 or a rib 15 for supporting a circuit board 3 thereon. The circuit board 3 is interposedly arranged between the rib 15 and a board contact rib of a lid member 51 which will be described hereinafter. When the lid member 51 is formed so as to be free from such a board contact rib, the circuit board 3 may be joined to the rib 15 by means of an adhesive such as a silicone resin adhesive, an epoxy resin adhesive or the like. The above-described opening of the insulating casing 1 is defined by a peripheral wall arranged so as to surround the open bottom end of the insulating casing 1 except one side thereof and arranged so as to communicate with the board receiving chamber 5. The peripheral wall 17 is adapted to be fitted in a fit groove formed in a transformer casing of a fly-back transformer (not shown).

The insulating casing 1 is formed on an inner surface thereof defining the board receiving chamber 5 with four terminal fitment fit sections 19, 21, 23 and 25. The terminal fitment fit sections 19 and 21 are fitted therein with a terminal fitment 29 (FIGS. 1C and 4) arranged in correspondence to the focus voltage output electrode E2 and a terminal fitment 29 (FIGS. 1C and 7) arranged in correspondence to the screen voltage output electrode E3, respectively. In the illustrated embodiment, the terminal fitment fit sections 19, 21, 23 and 25 are fitted therein with terminal fitments 29 each formed into an identical configuration, respectively. The terminal fitment fit sections 19 to 25 are provided at an opening thereof with coiled spring receiving sections 19A, 21A, 23A and 25A, respectively, in each of which is a coiled spring 30 is received.

In correspondence to the terminal fitment fit sections 19 to 25, the insulating casing 1 is formed at an upper wall thereof with four expansions 31, 33, 35 and 37, respectively, as shown in FIG. 1A. The expansions 31 and 33 each constitute a connection conductor insertion section into which a connection conductor such as a pin terminal, a lead wire or the like is inserted and are formed with through-holes 39 and 41, respectively. Between the inner surface of the insulating casing 1 defining the board receiving section 5 and a front surface of the circuit board 3 is defined a space in which two sliders are rotatably received, as shown in FIG. 1C. In FIG. 1A, reference numerals 43 and 45 each designate an operation shaft arranged so as to rotatably extend through the upper wall of the insulating casing 1 to externally operate the slider.

The fixed resistor receiving chamber 6 has a so-called bleeder resistance 47 received therein. The bleeder resistance 47 is interposedly supported between two holding sections 49 and 50 which are arranged in the fixed resistance receiving chamber so as to vertically extend therein and provided so as to interposedly support it therebetween.

The terminal fitment fit sections 19, 21, 23 and 25 may be constructed in substantially the same manner. Also, the terminal fitments 29 respectively fitted in four such terminal fitment fit sections 19 to 25 may be constructed in substantially the same manner.

The terminal fitments 29, as shown in FIGS. 4A to 4D, each are formed by bending a conductive sheet of metal such as stainless steel, bronze or the like pressed into a predetermined shape into an L-like configuration, to thereby permit connection of the connection conductor without soldering. The conductive metal sheet is preferably subjected to bending so as to exhibit elasticity and may be made of a SUS 301 stainless steel sheet of 0.1 to 0.4 mm in thickness, a bronze sheet of 0.2 to 0.5 mm in thickness or the like. The terminal fitments 29 each include a first conductor holding section 29A and a second holding section 29B which are arranged so as to extend in directions of intersecting substantially perpendicularly to each other.

The first conductor holding section 29A includes a plate-like portion 29*a*, which is constituted by a disc portion 29*b* of a substantially circular shape and a connection portion 29*c*. The disc portion 29*b* is formed with four slits S1 to S4 in a manner to radially outwardly extend at substantially equal angular intervals from a center thereof, so that edges 29*d* to 29*g* of a triangular shape may be defined between the respective adjacent two of the slits S1 to S4. The edges 29*d* to 29*g* each are adapted to bite into an outer peripheral surface of the connection conductor when it is inserted through the terminal fitment 29. The edges 29*d* to 29*g* are formed so as to be inclined in a direction in which the connection conductor is inserted through the terminal fitment 29. The edges 29*d* to 29*g* each are formed at a distal end thereof positioned on a side of the center of the disc portion 29*b* with an arcuate cutout having a sharp corner formed on each of both sides thereof, so that the arcuate cutouts of the edges 29*d* to 29*g* cooperate with each other to define a circular hole positioned at the center of the disc portion 29*b* through which the connection conductor is inserted. Thus, application of drawing force to the connection conductor inserted through the hole of the disc portion 29*b* permits each of the edges 29*d* to 29*g* to readily deeply bite into the outer periphery of the connection conductor, to thereby prevent the connection conductor from being readily released from the disc portion 29*b* and therefore the first conductor holding section 29A.

The second conductor holding section 29B likewise includes a plate-like portion 29*h*, which is constituted by a rectangular portion 29*i* and a connection portion 29*i*. The rectangular portion 29*i* is formed with four edges 29*k*, 29*l*, 29*m* and 29*n* by pressing. The edges 29*k* to 29*n* are formed so as to be inclined in a direction in which the connection conductor is inserted therethrough. Also, the edges 29*k* to 29*n* are constructed so as to prevent the connection conductor from being cut thereby when turning force is applied to the connection conductor held by the edges. More specifically, the edges 29*k* to 29*n* each are formed at a distal end thereof into a rounded or curved projection-like shape. The curved projection is preferably arcuate. Thus, the edges 29*k* to 29*n* each are free from any sharp corner on each of both lateral sides of the distal end thereof, unlike the above-described edges 29*d* to 29*g* each having two sharp edges formed on both lateral sides of the distal end thereof. Such construction of the edges 29*k* to 29*n* prevents the edges 29*k* to 29*n* from cutting the connection conductor when the connection conductor is turned about a central axis thereof while being kept interposedly held by the edges. Also, the above-described construction of the edges 29*k* to 29*n* permits a corner to be formed on each of both ends thereof in a thickness direction thereof, so that application of drawing force to the connection conductor permits the edges 29*k* to 29*n* to bite into the outer peripheral surface of the connection conductor through the corner.

Figure 3A:
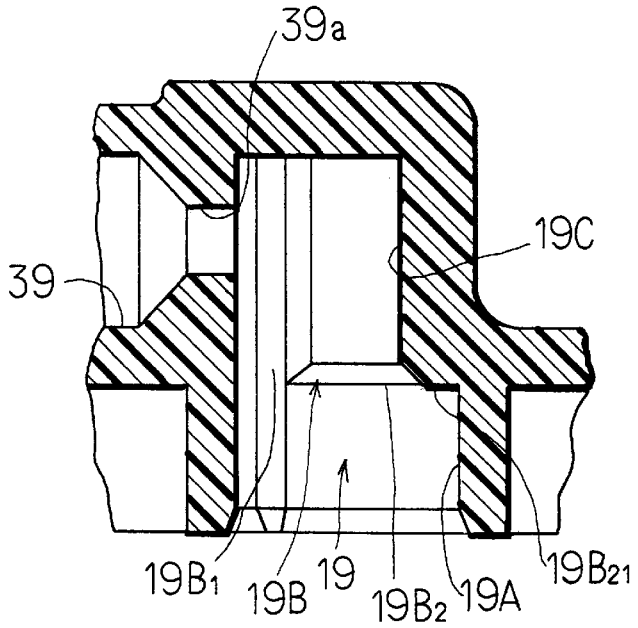
FIG. 3A is a fragmentary enlarged sectional view showing a terminal fitment fit section.
Figure 3B:
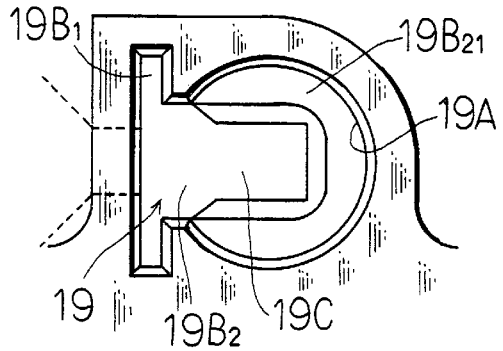
FIG. 3B is a fragmentary enlarged plan view of the terminal fitment fit section shown in FIG. 3A.
Figure 4A:
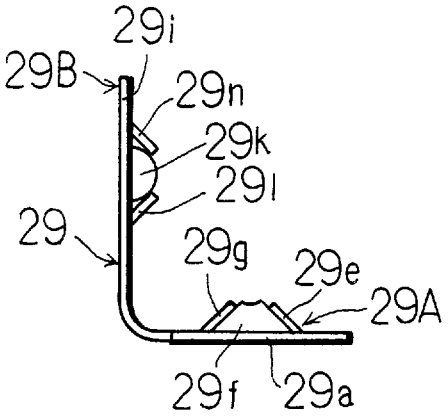
FIG. 4A is a right side elevation view showing a terminal fitment.
Figure 4B:
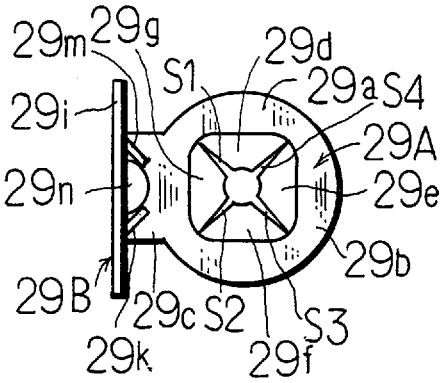
FIG. 4B is a plan view of the terminal fitment shown in FIG. 4A.
Figure 4C:
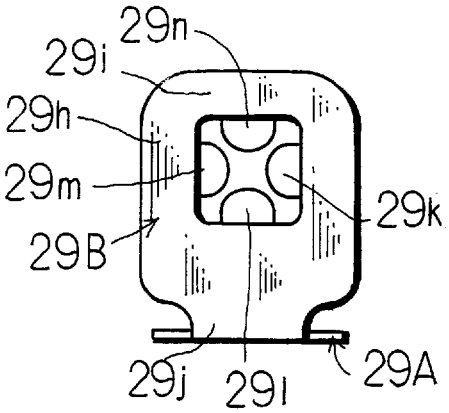
FIG. 4C is a front elevation view of the terminal fitment shown in FIG. 4A.
Figure 4D:
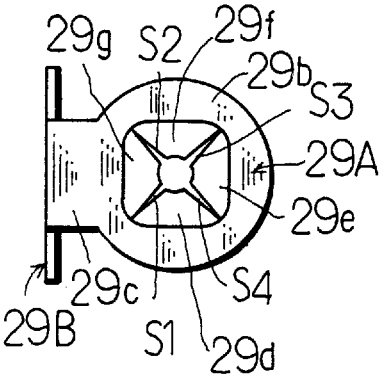
FIG. 4D is a bottom view of the terminal fitment shown in FIG. 4A.

The terminal fitment fit sections 19, 21, 23 and 25 are constructed in substantially the same manner, thus, the terminal fitment fit section 19 will be described hereinafter with reference to FIGS. 3A and 3B by way of example.

The terminal fitment fit section 19 includes the coiled spring receiving portion 19A briefly described above, a terminal fitment receiving portion 19B and a connection conductor insertion portion 19C. The coiled spring receiving portion 19A is formed into a substantially cylindrical shape of which a part is cut away. The terminal fitment receiving portion 19B includes a first portion 19B1 into which the plate-like portion 29*h* of the second conductor holding section 29B of the terminal fitment 29 is inserted and a second portion 19B2 into which the plate-like portion 29*a* of the first conductor holding section 29A of the terminal fitment 29 is inserted. A boundary between the coiled spring receiving portion 19A and the terminal fitment receiving portion 19B is formed with a support step 19B21 on which an outer periphery of the disc portion 29*b* of the first conductor holding section 29A of the terminal fitment 29 is supported. The connection conductor insertion portion 19C of the terminal fitment fit section 19 is formed so as to communicate with a small opening 39*a* formed at a distal end of the through-hole 39.

In order to facilitate incorporation of the coiled spring 30 into the insulating casing 1 for assembling of the resistor unit, the coiled spring receiving portion 19A of the terminal fitment fit section 19 is preferably constructed so as to receive therein at least a part of the coiled spring 30 kept compressed. Also, the coiled spring 30 is received at a part thereof or one end thereof in the coiled spring receiving portion 19A prior to compression. Incorporation of the coiled spring 30 into the insulating casing is accomplished by inserting one end of the coiled spring 30 into the coiled spring receiving portion 19A. Also, most or all of the coiled spring 30 is received in the coiled spring receiving portion 19A while being compressed in the course that the circuit board 3 is inserted into the insulating casing 1 to compress the coiled spring 30, so that the assembling may be readily accomplished without paying any attention to a posture of the coiled spring 30.

The board receiving chamber 5, as shown in FIG. 1C, is covered with the above-described lid member 51 made of a synthetic resin material similar that for the insulating casing 1. The lid member 51 is formed on a front surface thereof with a board contact rib (not shown) with which the circuit board 3 is contacted. Such a board contact rib is detailedly described with reference to FIG. 7 in U.S. Pat. No. 5,508,678 described above. The lid member 51 is formed on a rear surface thereof with a recess 53, in which a part of a capacitor C electrically connected to the focus voltage output electrode E2 is received. In FIG. 1C, the capacitor C is indicated together with capacitor holding elements 54 for the sake of convenience, although the capacitor actually should not be indicated therein. The capacitor holding elements 54 are formed integrally with the lid member 51. The lid member 51 is arranged so as to close the opening of the insulating casing 1 or the board receiving chamber 5 while keeping the front surface thereof facing a rear surface of the variable resistance circuit board 3. The fit groove 13 is fitted therein with a fit peripheral wall member 55, to thereby constitute a fit structure which functions to prevent intrusion of insulating resin for molding into the board receiving chamber 5. The fit structure thus provided functions to satisfactorily securely fix the lid member 51 onto the insulating casing 1. Nevertheless, an adhesive may be applied between the wall member 55 and the fit groove 13.

The lid member 51 is formed with a first through-hole 51*a* through which the capacitor connection conductor 59 briefly described above is inserted as shown in FIGS. 1C and 5, as well as a second through-hole 51*b* through which the input connection conductor or ground connection conductor 61 briefly described above is inserted as shown in FIG. 6.

Figure 5:
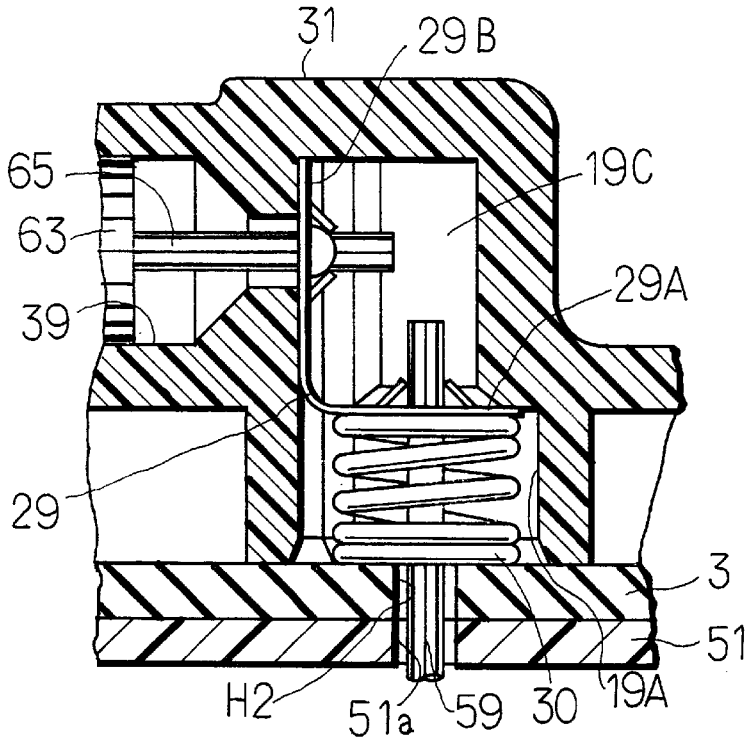
FIG. 5 is a sectional view showing a focus voltage output section.

Now, a focus voltage output section will be described hereinafter with reference to FIG. 5. In FIG. 5, reference numeral 63 designates a coated insulating lead wire for focus voltage output, of which the core 65 briefly described above constitutes the connection conductor for focus voltage output. The first conductor holding section 29A of the terminal fitment 29 functions to interposedly hold an end of the capacitor connection conductor or first connection conductor 59 therein and the second conductor holding section 29B interposedly holds an end of the core 65 of the lead wire 63 therein. The terminal fitment 29 and coiled spring 30 cooperate with each other to constitute a terminal assembly and the coiled spring 30 provides a conductive contact member. The coiled spring 30 is made by forming a conductive wire into a spiral shape. The coiled spring 30 is arranged so as to spirally surround the capacitor connection conductor 59 and be compressed between the focus voltage output electrode E2 and the first conductor holding section 29A of the terminal fitment 29.

Figure 6:
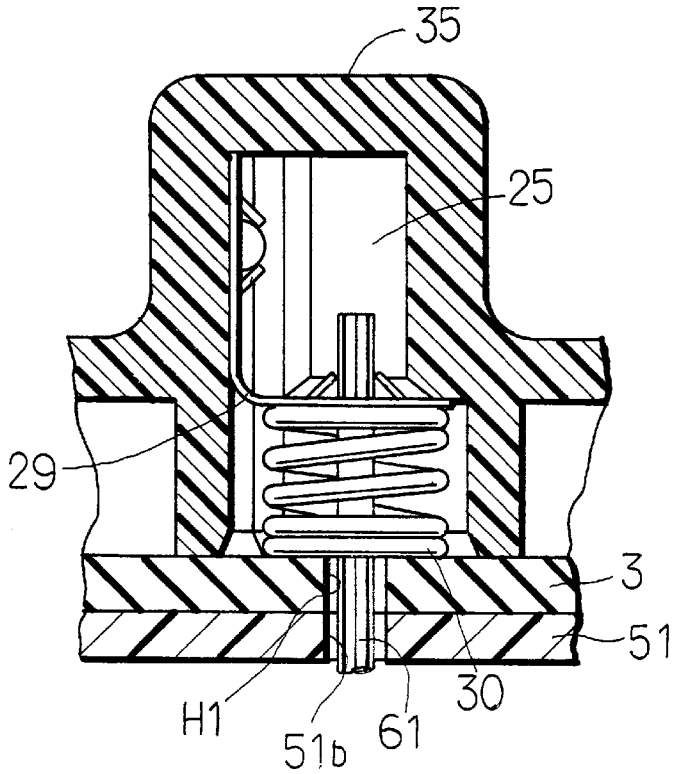
FIG. 6 is a sectional view showing an input electrode section.

FIG. 6 shows an input electrode section which is not shown in FIG. 1C. A terminal assembly for the input electrode section is likewise constituted by the terminal fitment 29 and coiled spring 30. The coiled spring 30 is arranged so as to surround the input connection conductor 61 and be compressed between the input electrode El and the first conductor holding section 29A of the terminal fitment 29. A ground electrode section may be constructed in substantially the same manner as the input electrode section, except that the coiled spring 30 is arranged so as to surround the ground connection conductor and be compressed between the ground electrode E4 and the first conductor holding section 29A.

Figure 7:
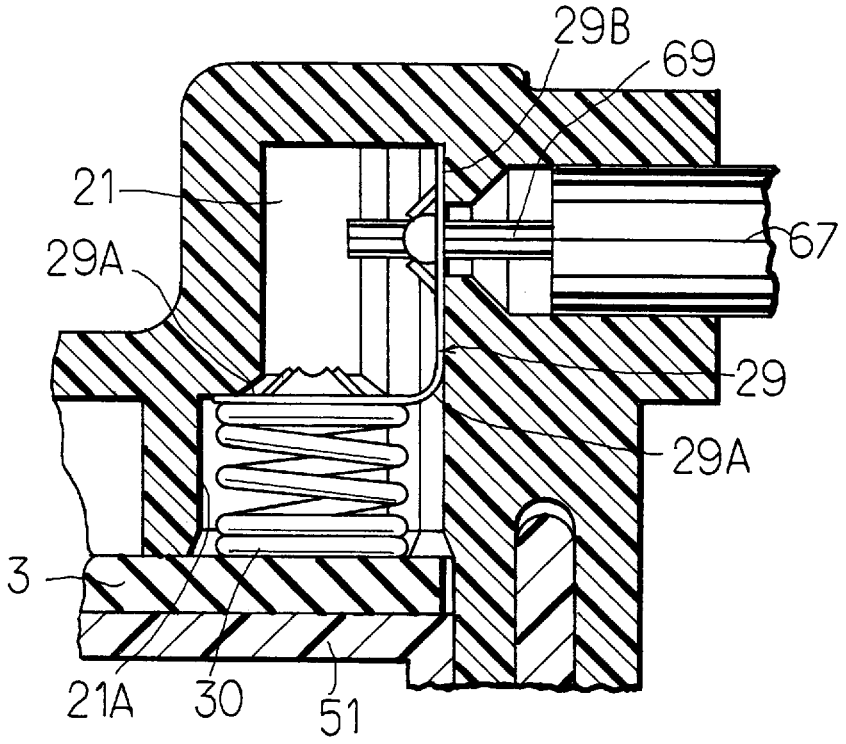
FIG. 7 is a sectional view showing a screen voltage output section.

Now, a screen voltage output section will be described with reference to FIG. 7. In FIG. 7, reference numeral 67 designates a coated insulating lead wire, of which a core 69 constitutes the above-described connection conductor for screen voltage output. The first conductor holding section 29A of the terminal fitment 29 is merely kept contacted with the coiled spring 30. The second conductor holding section 29B interposedly holds an end of the core 69 of the lead wire 67. Thus, the terminal fitment 29 and coiled spring 30 cooperate together to constitute a terminal assembly and the coiled spring constitutes a conductive contact member. Also, the coiled spring 30 is arranged so as to be compressed between the screen voltage output electrode E3 and the first conductive holding section 29A of the terminal fitment 29.

In the illustrated embodiment, the terminal assembly for electrically connecting the connection conductor and electrode to each other without soldering is employed for every electrode. Thus, the illustrated embodiment permits the terminals for the high-voltage variable resistor to be completely free from soldering or completely soldering-less. However, in practicing of the present invention, it is not required to carry out connection of the connection conductors to all the electrodes in a soldering-less manner. The terminal assembly may be used for connecting the connection conductor to one of the electrodes without soldering.

In the illustrated embodiment, the terminal fitments each include the first conductor holding section 29A and second conductor holding section 29B constructed in a different manner. Alternatively, the first conductor holding section 29A may be constructed in substantially the same manner as the second conductor holding section 29B.

Also, the terminal fitments 29 each are preferably formed by subjecting a single conductive metal sheet to working irrespective of the number of conductor connection sections. The conductor holding section is provided with a plurality of the edges which are adapted to bite into the connection conductor when drawing force is applied to the connection conductor. Such construction of the conductor holding section is disclosed in U.S. Patents Nos. 5,546,280 and 5,508,678 by way of example. The terminal fitment disclosed in each of the U.S. patents does cause any problem so long as it is constructed so as to permit only drawing force to be applied to the connection conductor when the connection conductor is held in the conductor holding section. However, as described above, it causes the connection conductor to be cut by the edges in the worst case when turning force for turning the connection conductor about its central axis is repeatedly applied to the connection conductor. In order to avoid such a disadvantage of the prior art, it is required to form the edges of the conductor holding section into a configuration which prevents application of turning force to the connection conductor. The above-described construction of the illustrated embodiment wherein the edges of the conductor holding section biting into the connection conductor each are formed at the distal end thereof into a shape like a rounded or curved projection effectively eliminates the problem encountered with the prior art. In particular, when the terminal fitment includes the first and second conductor holding sections, the second conductor holding section is formed at the distal end thereof into a shape free from any sharp corner on each of the both lateral sides thereof. Ideally, the edges each are formed into an arcuate shape.

In the illustrated embodiment, the first to fourth terminal fitments 19 to 25 are constructed into substantially the same configuration and the coiled springs 30 are likewise constructed in the same manner. This permits the number of kinds of the parts to be substantially reduced, leading to a significant reduction in manufacturing cost.

Also, the illustrated embodiment is so constructed that the lid member 51 is integrally provided on the rear surface thereof with a plurality of the holding elements 54 for interposedly holding the capacitor. This facilitates mounting and holding of the capacitor.

The coiled springs incorporated in the electric component of the present invention each are constructed so as to permit elastic force to be finely and freely set, resulting in readily exhibiting elasticity of any desired level smaller than that of a conductive rubber material. Also, the present invention, even when the coiled spring or terminal fitment is incorporated in the electric component of the present invention while being somewhat inclined, permits such inclination to be absorbed in the form of deformation of the coiled spring during compression of the coiled spring in a direction of forcing of the coiled spring. This ensures positive electrical contact between the terminal fitments and the electrodes on the circuit board even when the electric component is assembled with somewhat reduced accuracy.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An electric component comprising:

a circuit board formed on a front surface thereof with a circuit pattern including at least one contact electrode;

an insulating casing formed so as to be open at one of ends thereof to provide an opening and provided therein with a board receiving chamber communicating with said opening;

said circuit board being received in said board receiving chamber of said insulating casing while keeping said front surface thereof facing an inside of said board receiving chamber;

at least one terminal assembly arranged between said circuit board and an inner surface of said insulating casing defining said board receiving chamber;

said inner surface of said insulating casing being formed with at least one terminal fitment fit section; and at least one connection conductor inserted into said board receiving chamber;

said terminal assembly including at least one terminal fitment and at least one conductive contact member interposedly held between said terminal fitment and said contact electrode on said front surface of said circuit board;

said terminal fitment including at least one conductor holding section for interposedly holding an end of said connection conductor fitted in said terminal fitment fit section and inserted into said board receiving chamber;

said conductive contact member being constituted by a coiled spring obtained by forming a conductive wire into a spiral shape;

said coiled spring being arranged so as to be compressed between said contact electrode and said terminal fitment.

2. An electric component comprising:

a circuit board formed on a front surface thereof with a circuit pattern including at least one contact electrode;

an insulating casing formed so as to be open at one of ends thereof to provide an opening and provided therein with a board receiving chamber communicating with said opening;

said circuit board being received in said board receiving chamber of said insulating casing while keeping said front surface thereof facing an inside of said board receiving chamber;

at least one terminal assembly arranged between said circuit board and an inner surface of said insulating casing defining said board receiving chamber;

said inner surface of said insulating casing being formed with at least one terminal fitment fit section; and at least one connection conductor inserted into said board receiving chamber;

said terminal assembly including at least one terminal fitment and at least one conductive contact member interposedly held between said terminal fitment and said contact electrode on said front surface of said circuit board;

said terminal fitment including at least one conductor holding section for interposedly holding an end of said connection conductor fitted in said terminal fitment fit section and inserted into said board receiving chamber;

said conductive contact member being constituted by a coiled spring obtained by forming a conductive wire into a spiral shape;

said coiled spring being arranged so as to be compressed between said contact electrode and said conductor holding section.

3. An electric component comprising:

a circuit board having a front surface and a rear surface and formed with a through-hole via which a first connection conductor is inserted from a side of said rear surface thereof;

said circuit board being formed on said front surface thereof with a circuit pattern including at least one contact electrode arranged adjacent to said through-hole;

an insulating casing formed so as to be open at one of ends thereof to provide an opening and provided therein with a board receiving chamber communicating with said opening;

said insulating casing being formed on an inner surface of said insulating casing defining said board receiving chamber with a connection conductor introduction section through which a second connection conductor is inserted at an end thereof into said board receiving chamber from an outside of said insulating casing;

said circuit board being received in said board receiving chamber of said insulating casing while keeping said front surface thereof facing an inside of said board receiving chamber; and at least one terminal assembly arranged between said circuit board and said inner surface of said insulating casing defining said board receiving chamber;

said inner surface of said insulating casing being formed with at least one terminal fitment fit section;

said terminal assembly including at least one terminal fitment and at least one conductive contact member;

said terminal fitment including a first conductor holding section for interposedly holding an end of said first connection conductor fitted in said terminal fitment fit section and inserted into said board receiving chamber via said through-hole and a second conductor holding section for interposedly holding said end of said second connection conductor inserted from said connection conductor introduction section into said board receiving chamber;

said conductive contact member being interposedly supported between said first conductor holding section of said terminal fitment and said contact electrode on said front surface of said circuit board;

said conductive contact member being constituted by a coiled spring obtained by forming a conductive wire into a spiral shape;

said coiled spring being arranged so as to spirally surround said first connection conductor and be compressed between said contact electrode and said first conductor holding section.

4. An electric component comprising:

a circuit board having a front surface and a rear surface and formed with a through-hole via which a connection conductor is inserted from a side of said rear surface thereof;

said circuit board being formed on said front surface thereof with a circuit pattern including at least one contact electrode arranged adjacent to said through-hole;

an insulating casing formed so as to be open at one of ends thereof to provide an opening and provided therein with a board receiving chamber communicating with said opening;

said circuit board being received in said board receiving chamber of said insulating casing while keeping said front surface thereof facing an inside of said board receiving chamber; and at least one terminal assembly arranged between said circuit board and an inner surface of said insulating casing defining said board receiving chamber;

said inner surface of said insulating casing being formed with at least one terminal fitment fit section;

said terminal assembly including at least one terminal fitment and at least one conductive contact member;

said terminal fitment including a conductor holding section for interposedly holding an end of said connection conductor fitted in said terminal fitment fit section and inserted into said board receiving chamber via said through-hole;

said conductive contact member being interposedly supported between said conductor holding section of said terminal fitment and said contact electrode on said front surface of said circuit board;

said conductive contact member being constituted by a coiled spring obtained by forming a conductive wire into a spiral shape;

said coiled spring being arranged so as to spirally surround said connection conductor and be compressed between said contact electrode and said conductor holding section.

5. An electric component as defined in any one of claims 1 to 4, wherein said terminal fitment fit section includes a coiled spring receiving portion for receiving therein at least a part of said coiled spring kept compressed.

6. An electric component as defined in any one of claims 1 to 4, wherein said terminal fitment is formed by subjecting a single conductive metal sheet to working; and said conductive holding section includes a plurality of edges biting into said end of said connection conductor when drawing force is applied to said connection conductor;

said edges of said conductive holding section for interposedly holding said connection conductor to which turning force is applied being formed so as to be free from any sharp corner in a direction of surrounding said connection conductor.

7. An electric component as defined in any one of claims 1 to 4, wherein said terminal fitment is formed by subjecting a single conductive metal sheet to working; and said conductive holding section includes a plurality of edges biting into said end of said connection conductor when drawing force is applied to said connection conductor;

said edges of said conductive holding section for interposedly holding said connection conductor to which turning force is applied being formed at a distal end thereof into a rounded projection of an arcuate shape.

8. A high-voltage variable resistor unit comprising:

a circuit board provided on a front surface thereof with a plurality of electrodes including a contact electrode and a variable resistance circuit pattern;

an insulating casing made of an insulating resin material, formed so as to be open at one of ends thereof to provide an opening and provided therein with a board receiving chamber communicating with said opening;

at least one slider arranged in a space defined between said front surface of said circuit board and an inner surface of said insulating casing defining said board receiving chamber and operated from an outside of said insulating casing;

said circuit board being received in said board receiving chamber of said insulating casing while keeping said front surface thereof facing an inside of said board receiving chamber;

at least one terminal assembly arranged between said circuit board and said inner surface of said insulating casing defining said board receiving chamber;

said inner surface of said insulating casing being formed with at least one terminal fitment fit section; and at least one connection conductor inserted into said board receiving chamber;

said terminal assembly including at least one terminal fitment and at least one conductive contact member;

said terminal fitment including at least one conductor holding section for interposedly holding an end of said connection conductor fitted in said terminal fitment fit section and inserted into said board receiving chamber;

said conductive contact member being interposedly held between said conductor holding section of said terminal fitment and said contact electrode on said front surface of said circuit board;

said conductive contact member being constituted by a coiled spring obtained by forming a conductive wire into a spiral shape;

said coiled spring being arranged so as to be compressed between said contact electrode and said conductor holding section.

9. A high-voltage variable resistor unit comprising:

a circuit board having a front surface and a rear surface and formed on said front surface thereof with an input electrode, a ground electrode, at least one focus voltage output electrode to which a capacitor is connected, a screen voltage output electrode and a variable resistance circuit pattern;

said circuit board being formed with through-holes which are arranged at a central portion of said input electrode, ground electrode and focus voltage output electrode and into which an input connection conductor, a ground connection conductor and at least one capacitor connection conductor are inserted, respectively;

an insulating casing made of an insulating resin material, formed so as to be open at one of ends thereof to provide an opening and provided therein with a board receiving chamber communicating with said opening;

at least one focus voltage output connection conductor and a screen voltage output connection conductor inserted into said board receiving chamber;

said insulating casing being formed on an inner surface thereof defining said board receiving chamber with a plurality of connection conductor introduction sections through which said focus voltage output connection conductor and screen voltage output connection conductor are inserted at an end thereof into said board receiving chamber from an outside of said insulating casing, respectively;

a plurality of sliders arranged in a space defined between said front surface of said circuit board and said inner surface of said insulating casing defining said board receiving chamber and operated from the outside of said insulating casing;

a lid member arranged so as to cover said opening of said insulating casing while keeping a front surface thereof facing said rear surface of said circuit board and formed with a plurality of through-holes via which said input connection conductor, ground connection conductor and capacitor connection conductor are inserted, respectively; and a plurality of terminal assemblies arranged between said input electrode, ground electrode, focus voltage output electrode and screen voltage output electrode on said circuit board and said inner surface of said insulating casing defining said board receiving chamber, respectively;

said inner surface of said insulating casing defining said board receiving chamber being formed with a plurality of terminal fitment fit sections;

said terminal assemblies being fitted in said terminal fitment fit sections, respectively;

said terminal assembly arranged in correspondence to said focus voltage output electrode to which said capacitor is connected including a first terminal fitment and a first conductive contact member;

said first terminal fitment including a first conductor holding section for interposedly holding an end of said capacitor connection conductor inserted into said board receiving chamber through said through-hole of said circuit board and a second conductor holding section for interposedly holding an end of said focus voltage output connection conductor inserted through said connection conductor introduction section into said board receiving chamber;

said first conductive contact member being interposedly supported between said first conductor holding section of said terminal fitment and said contact electrode on said front surface of said circuit board;

said first conductive contact member being constituted by a coiled spring formed by subjecting a conductive wire to spiral working and arranged so as to spirally surround said capacitor connection conductor and be compressed between said focus voltage output electrode and said first conductor holding section;

said terminal assembly arranged in correspondence to said screen voltage output electrode including a second terminal fitment and a second conductive contact member;

said second terminal fitment including a conductor holding section for interposedly holding an end of said screen voltage output connection conductor inserted into said board receiving chamber;

said second conductive contact member being interposedly supported between said second terminal fitment and said screen voltage output electrode on said front surface of said circuit board;

said second conductive contact member being constituted by a coiled spring formed by subjecting a conductive wire to spiral working and arranged so as to be compressed between said screen voltage output electrode and said second terminal fitment;

said terminal assembly arranged in correspondence to said ground electrode including a third terminal fitment and a third conductive contact member;

said third terminal fitment including a conductor holding section for interposedly holding an end of said ground connection conductor inserted into said board receiving chamber;

said third conductive contact member being interposedly supported between said conductor holding section of said third terminal fitment and said ground electrode on said front surface of said circuit board;

said third conductive contact member being constituted by a coiled spring formed by subjecting a conductive wire to spiral working and arranged so as to spirally surround said ground connection conductor and be compressed between said ground electrode and said conductor holding section;

said terminal assembly arranged in correspondence to said input electrode including a fourth terminal fitment and a fourth conductive contact member;

said fourth terminal fitment including a conductor holding section for interposedly holding an end of said input connection conductor inserted into said board receiving chamber;

said fourth conductive contact member being interposedly supported between said conductor holding section of said fourth terminal fitment and said input electrode on said front surface of said circuit board;

said fourth conductive contact member being constituted by a coiled spring formed by subjecting a conductive wire to spiral working and arranged so as to spirally surround said input connection conductor and be compressed between said input electrode and said conductor holding section.

10. A high-voltage variable resistor unit as defined in claim 9, wherein said first to fourth terminal fitments each are formed into an identical configuration.

11. A high-voltage variable resistor unit as defined in claim 10, wherein said terminal fitment fit section includes a coiled spring receiving section in which at least a part of said coiled spring kept compressed is received.

12. A high-voltage variable resistor unit as defined in claim 9, wherein said lid member is integrally provided on a rear surface thereof with a plurality of holding elements for interposedly holding said capacitor.

* * * * *